US007178803B2

(12) United States Patent
Nally et al.

(10) Patent No.: US 7,178,803 B2
(45) Date of Patent: Feb. 20, 2007

(54) GAME TABLE HAVING STORAGE COMPARTMENT IN CORNER MEMBER

(75) Inventors: Michael Nally, Ridgewood, NJ (US); Marc Dubner, Succasunna, NJ (US)

(73) Assignee: Sportcraft, Ltd. (US)

( * ) Notice: Subject to any disclaimer, the term of this patent is extended or adjusted under 35 U.S.C. 154(b) by 0 days.

(21) Appl. No.: 11/034,476

(22) Filed: Jan. 13, 2005

(65) Prior Publication Data

US 2005/0151316 A1 Jul. 14, 2005

Related U.S. Application Data

(60) Provisional application No. 60/536,202, filed on Jan. 13, 2004.

(51) Int. Cl.
*A63F 7/07* (2006.01)
*A63B 67/14* (2006.01)

(52) U.S. Cl. ..... 273/126 R; 273/108; 273/118 R; 273/108.1

(58) Field of Classification Search ..... 273/126 R, 273/126 A, 108, 118 R, 119 R, 108.1; 473/4, 473/19, 33; 108/25, 26, 28
See application file for complete search history.

(56) References Cited

U.S. PATENT DOCUMENTS 1,963,651 A * 6/1934 Collins ..... 108/26
1,979,301 A * 11/1934 Webb ..... 108/93
2,199,745 A * 5/1940 Harris ..... 273/309
2,526,793 A * 10/1950 Alfred ..... 108/93
2,569,007 A * 9/1951 Klyce ..... 108/170
4,838,179 A 6/1989 Bing
6,109,607 A * 8/2000 Cartwright et al. ..... 273/108.1
2005/0151316 A1* 7/2005 Nally et al. ..... 273/126 A
2005/0167908 A1* 8/2005 Nally et al. ..... 273/108.1

* cited by examiner

*Primary Examiner*—Raleigh W. Chiu
(74) *Attorney, Agent, or Firm*—Fellers, Snider, et al

(57) ABSTRACT

An air cushion game table is provided with a storage compartment useful for stowing game pieces during periods when the game table is not being utilized. The storage compartment is additionally useful for locating keys, watches, etc., that might distract a player during game play. The air cushion game table of the invention includes a playing surface bordered by side walls and end walls. Corner members are located proximate corners of the playing surface. The corner members define a storage receptacle on an outer surface thereof. Preferably, an outer surface of the corner member is flush with exterior apron segments of the game table to present a smooth and attractive appearance. A sliding door made up of slidably mounted segments may be provided for selectively enclosing the storage receptacle. The storage receptacle is preferably sized to receive playing equipment associated with the game table.

4 Claims, 4 Drawing Sheets

GAME TABLE HAVING STORAGE COMPARTMENT IN CORNER MEMBER

CROSS REFERENCE TO RELATED APPLICATION

This application claims the benefit of U.S. Provisional Patent Application Ser. No. 60/536,202 entitled HOCKEY GAME TABLE filed Jan. 13, 2004.

FIELD OF THE INVENTION

This invention relates generally to air cushion table games, and more particularly to an air hockey game table having improved features including a overhanging top rail, scoring and time displays and storage drawer.

BACKGROUND OF THE INVENTION

Typically, an air cushion game table includes a playing surface that is perforated to permit jets of air to pass through the playing surface for providing an air bed to facilitate low friction movement of a game piece, such as a puck, across an upper surface of the playing surface. Pressurized air is supplied from below the playing surface, which creates a multiplicity of closely spaced air jets emanating from the perforations in the playing surface. The table is bounded by side walls and end walls, which provide rebounding surfaces for the puck. Each player is provided with a pusher, which may be slid across the table surface and into contact with the puck. An automatic scoring system is sometimes provided to record the delivery of pucks into a goal. Several drawbacks associated with known air cushion tables include a tendency for the puck to occasionally exit the playing surface after a hard shot, awkwardly located automatic scoring displays and a lack of a suitable location for stowing game components during periods of non-use or for storing other articles during game play.

SUMMARY OF THE INVENTION

A storage compartment is provided for stowing game pieces during periods when the game table is not being utilized. Additionally, a storage compartment provides a handy location to place keys, watches, etc., that might distract a player during game play. The air cushion game table of the invention includes a playing surface bordered by side walls and end walls. Corner members are located proximate corners of the playing surface. The corner members define a storage receptacle on an outer surface thereof. Preferably, an outer surface of the corner member is flush with exterior apron segments of the game table to present a smooth and attractive appearance. A sliding door made up of slidably mounted segments may be provided for selectively enclosing the storage receptacle. The storage receptacle is preferably sized to receive playing equipment associated with the game table.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 3:
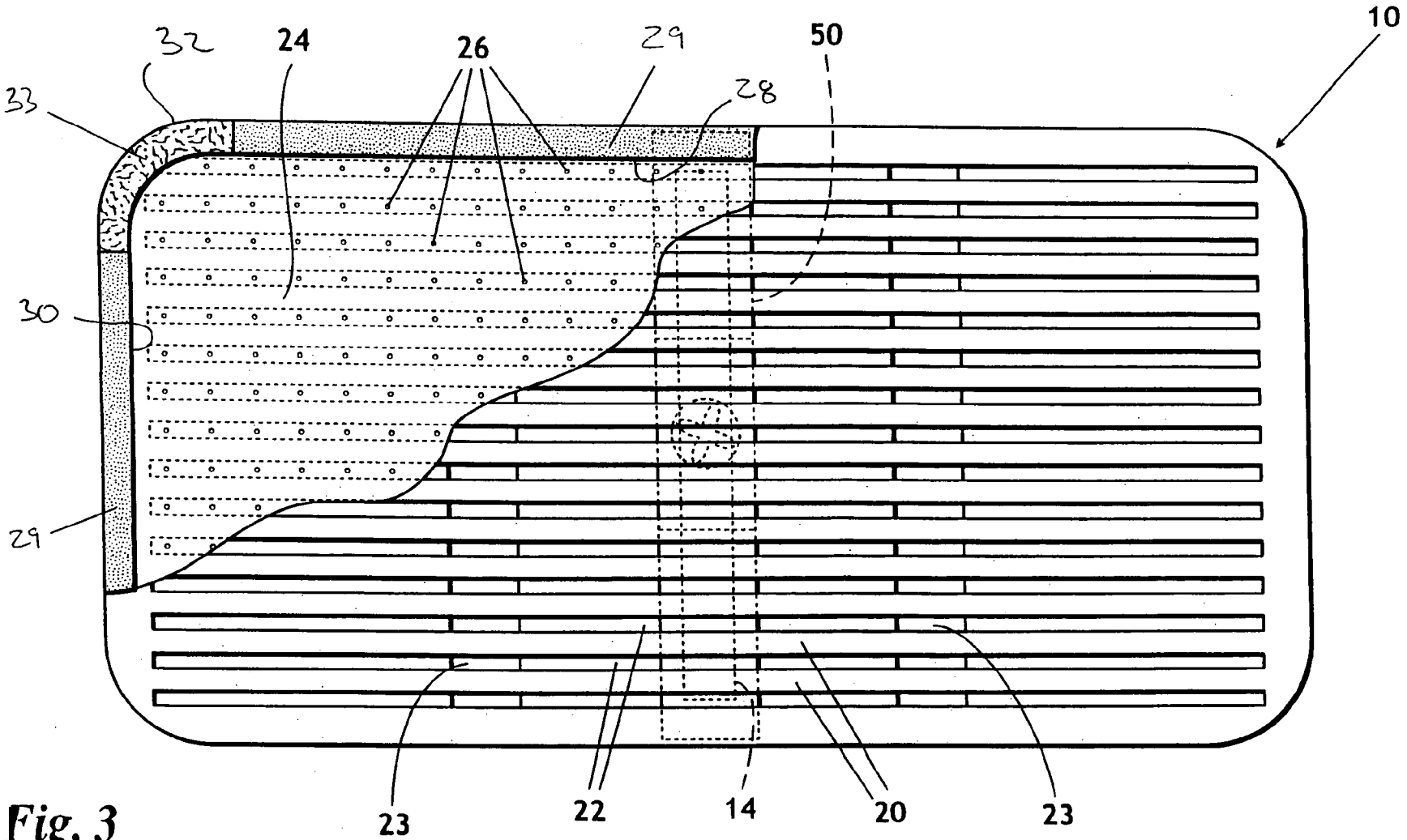
FIG. 3 is a top view of the air cushion game table of FIG. 1, showing a partial cut-away view of the game surface.

Referring now to FIGS. 1 through 4, shown is an air cushion game table 10. Air cushion game table 10 includes a bottom panel 12 (FIG. 2) that defines a central passageway 14 (FIG. 3). Four support legs 16 communicate with the bottom panel 12 for supporting the game table 10. A plurality of longitudinal support members 20 (FIGS. 3 and 4) support game surface 24. Air flow passes through passageways 23 and into longitudinal air channels 22. Longitudinal support members 20 define longitudinal air channels 22 (FIGS. 3 and 4) between adjacent longitudinal support members 20.

Game surface 24 has a plurality of small openings 26 (FIG. 3) formed therein for allowing jets of air to flow through the game surface 24. The air jets provide an air cushion on an upper side of the game surface 24. The small openings 26 are located above the longitudinal air channels 22 (best seen in FIG. 3).

Figure 1:
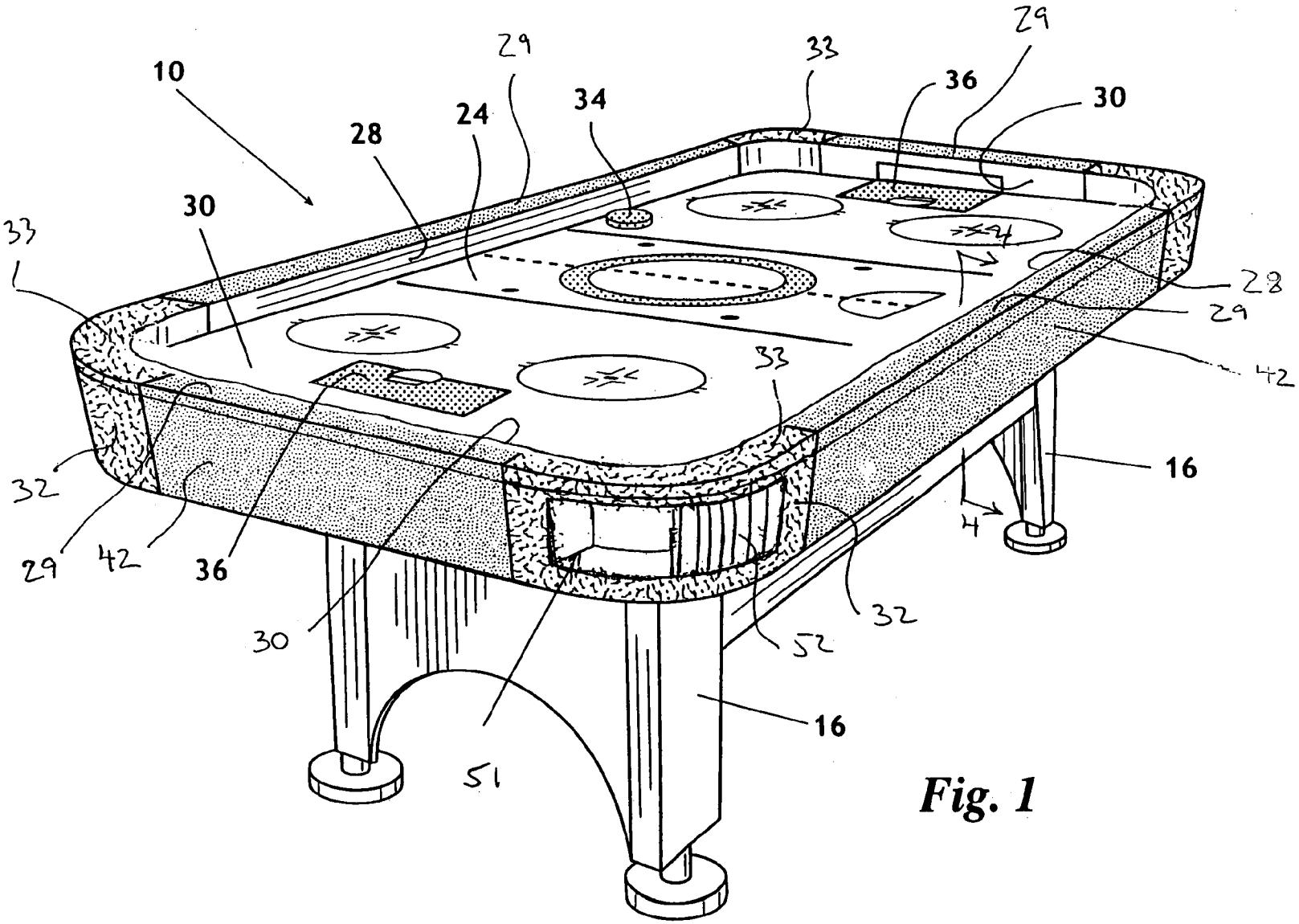
FIG. 1 is a perspective view of an air cushion game table.
Figure 2:
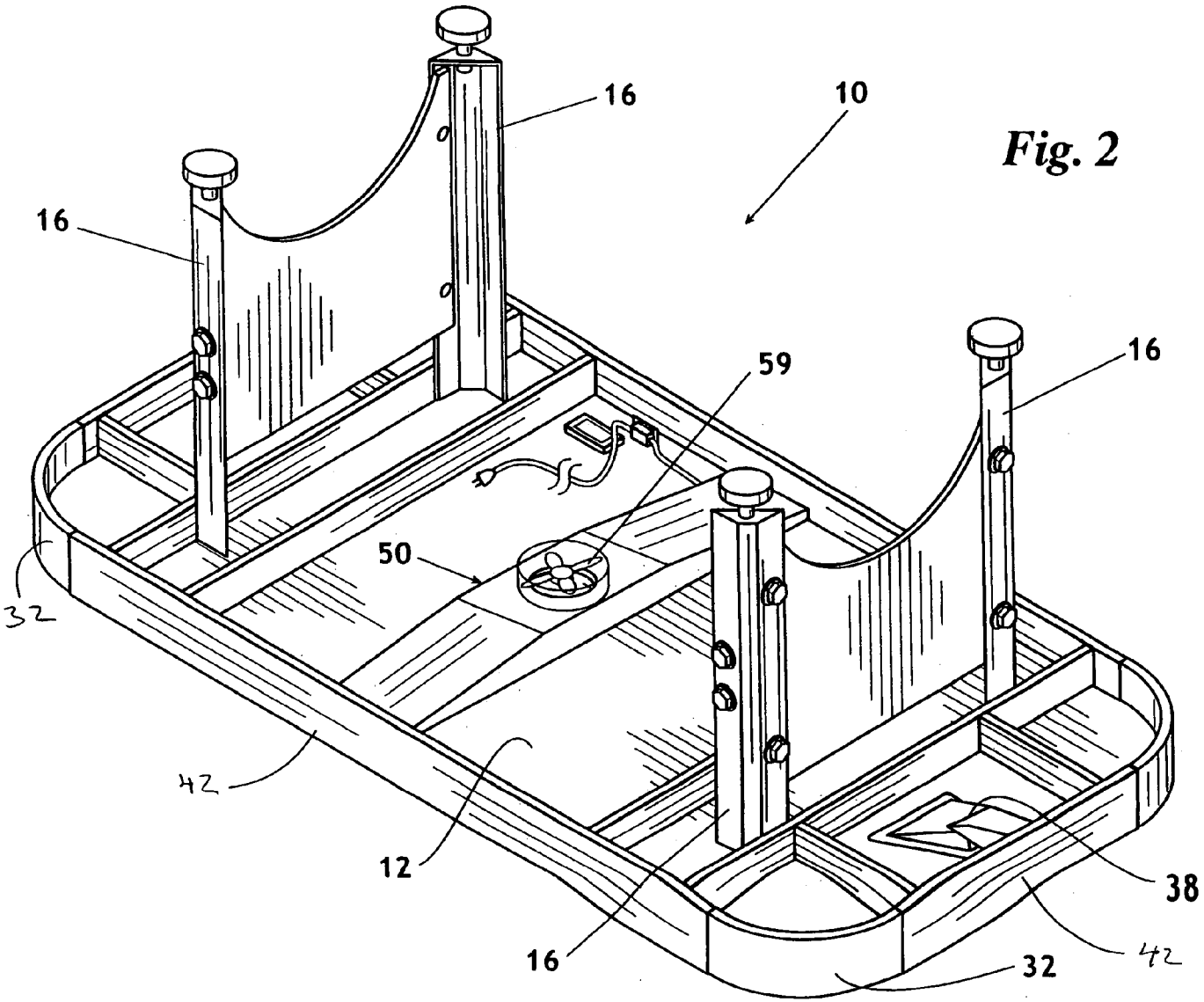
FIG. 2 is a perspective view of an underside of the air cushion game table of FIG. 1.
Figure 4:
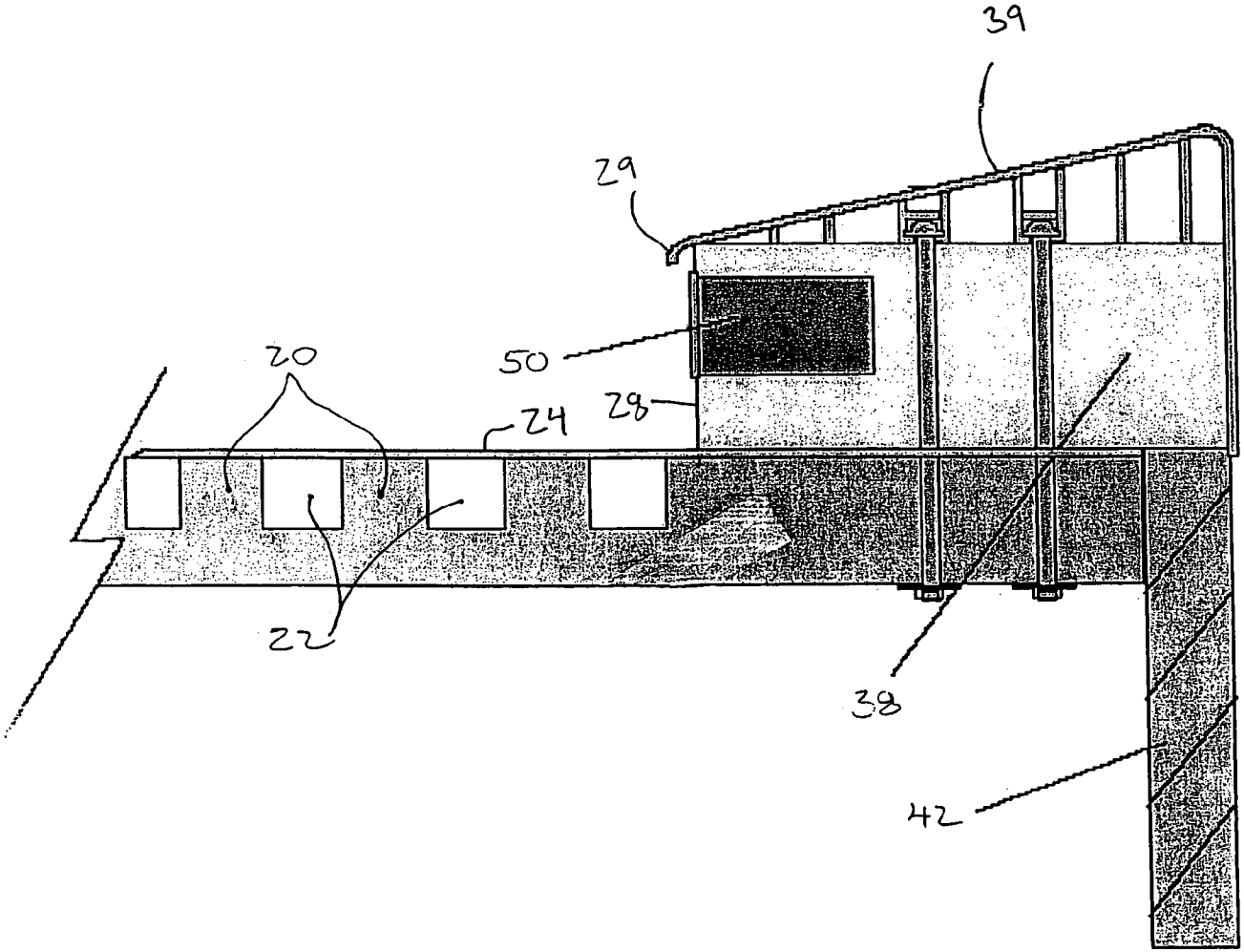
FIG. 4 is a cross-sectional view of the game table of FIG. 1, taken along line 4—4 of FIG. 1.

Referring now primarily to FIG. 1, game surface 24 is surrounded by side walls 28, end walls 30, and corner members 32 for containing a puck 34 on the upper surface of game surface 24. Sidewalls 28 and end walls 30 are preferably topped with a rail 29 (FIGS. 1, 4). Rails 29 are preferably provided with an overhang 29*a* (FIG. 4). Overhang 29*a* assists in preventing puck 34 from exiting the playing area during play. Corner members 32 are preferably provided with curved rails 33 having a similar overhang. Goals 36 are located proximate each end wall 30 for receiving the puck 34. Goals 36 may be integral with end wall 30 or may be located on the game surface 24. A puck return tray 38 (FIG. 2) is located on an underside of the bottom panel 12 for delivering the puck 34 to a player after the puck 34 is delivered to a goal 36 by an opposing player.

Rails 29, 33 are preferably extruded from aluminum, although other suitable materials may be used. Rails 29, 33 are secured to a base rail 38 (FIG. 4) by a plurality of bolts 40 (FIG. 4). An apron 42 is provided to maintain a pleasing external appearance.

Walls 28 and 30 and corner members 32 preferably have a sufficient height above the game surface 24 to accommodate display 50 (FIG. 4). Display 50 preferably has a face that is flush with a wall 28, 30 into which it is mounted. Display 50 is preferably spaced above game surface 24 by a height sufficient to allow puck 34 to impact walls 28 or 30 or corner members 32 without impacting display 50. However, if desired, display 50 may be provided such that display 50 forms an impact surface similar to other portions of walls 28, 30 and corner members 32. Display 50 is preferably an LED type display, although other display devices may be used. Display 50 may be used to display score, time remaining or other information. Preferably, display 50 may be activated by an easily accessible switch to which display 50 is electrically connected. The switch may protrude through rails 29, 33 at a location accessible by a user, e.g., near goals 36 or at a midpoint of rail 29. Additionally, display 50 may electrically communicate with a goal switch that is actuated by puck 34 entering a goal 36.

Locating display 50 integrally with walls 28, 30 and/or corners 32 provides improved visibility for contestants by eliminating vision obstructing structure seen on some existing designs.

Corner members 32 or apron 42 proximate sidewalls 28, 30 may be provided with a storage drawer 51. Storage drawer 51 may be provided with a door 52. Door 52 may be constructed of a plurality of slidably mounted segments, or may be of another construction. Storage drawer 51 is useful for locating playing equipment, such as puck 34 and pushers, when the table is not being used. Additionally, storage drawer 51 may be used to store personal items, such as keys and the like during game play.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An air cushion game table comprising:

a playing surface having a border comprised of side walls and end walls;

corner members proximate corners of said playing surface;

wherein said corner members define a recessed storage receptacle accessible through an outer surface of said corner member;

a door for selectively enclosing said recessed storage receptacle; and wherein said door is a sliding door that follows a path adjacent to said outer surface of said corner member.

2. The air cushion game table according to claim 1 wherein:

said storage receptacle is sized to receive playing equipment associated with the game table.

3. The air cushion game table according to claim 1 wherein:

said outer surface of said corner member is flush with exterior apron segments to present a smooth appearance.

4. An air cushion game table comprising:

a playing surface having a border comprised of side walls and end walls;

corner members proximate corners of said playing surface;

wherein said corner members define a storage receptacle on an outer surface thereof;

a door for selectively enclosing said storage receptacle; and wherein said door is a sliding door comprised of a plurality of slidably mounted segments.

* * * * *